US008469011B2

(12) United States Patent
Mroczka et al.

(10) Patent No.: US 8,469,011 B2
(45) Date of Patent: Jun. 25, 2013

(54) TOY HAND GRENADE

(76) Inventors: Jack Mroczka, Babylon, NY (US); David E. Mroczka, Babylon, NY (US)

( * ) Notice: Subject to any disclaimer, the term of this patent is extended or adjusted under 35 U.S.C. 154(b) by 196 days.

(21) Appl. No.: 13/090,528

(22) Filed: Apr. 20, 2011

(65) Prior Publication Data

US 2012/0266852 A1 Oct. 25, 2012

(51) Int. Cl.
*F41B 7/08* (2006.01)
*F41B 15/00* (2006.01)

(52) U.S. Cl.
USPC ..... 124/16; 124/37; 446/4; 446/475

(58) Field of Classification Search
USPC ..... 124/16, 26, 27, 37; 446/4, 6, 473, 446/475
See application file for complete search history.

(56) References Cited

U.S. PATENT DOCUMENTS

| | | | | |
|---|---|---|---|---|
| 4,944,521 | A * | 7/1990 | Greeno | 473/577 |
| 5,964,639 | A * | 10/1999 | Maxim | 446/437 |
| 5,996,503 | A * | 12/1999 | Woodall et al. | 102/498 |
| 6,311,681 | B1 * | 11/2001 | Snyder, Jr. | 124/59 |
| 6,453,819 | B1 * | 9/2002 | Coates | 102/498 |
| 7,784,455 | B1 * | 8/2010 | Chong | 124/73 |
| 2003/0036335 | A1 * | 2/2003 | Juy | 446/181 |
| 2008/0257193 | A1 * | 10/2008 | Siu et al. | 102/498 |

* cited by examiner

*Primary Examiner* — John Ricci
(74) *Attorney, Agent, or Firm* — Alix, Yale & Ristas, LLP

(57) ABSTRACT

A toy hand grenade has a plurality of bores which receive soft darts. A launcher is received in each bore and is spring loaded. An actuator retains the launchers in a spring-loaded, unactuated position. The actuator is displaceable relative to the body to release the launchers and substantially concurrently eject the darts from the hand grenade. A pin or a clip may be employed to lock the actuator in a locked position.

12 Claims, 4 Drawing Sheets

TOY HAND GRENADE

BACKGROUND

This disclosure relates generally to action toys. More particularly, this disclosure relates to toys which simulate weapons.

SUMMARY

Briefly stated, a toy hand grenade comprises an oval-like retainer body having a plurality of bores. A pivotal catch has an upper latch and opposed trigger lever and a spring loaded launcher for each bore. Each of the launchers is engaged by the catch. An actuator extends exteriorly from the body and is slidable between an actuated and an unactuated position. The actuator is interiorly engageable against the launcher to retain the launcher in a cocked position when the actuator is an unactuated position. A removable member locks the actuator in the unactuated position. A dart is received in each bore and is engageable against the launcher. When the locking member is removed and the actuator is forced to the actuated position. The actuator causes the trigger levers to pivot to release the launchers and eject the darts.

Each launcher has a generally T-shaped cross-section. The catch and the trigger lever are disposed at a substantially oblique angle about a medial pivot point. The actuator has an enlarged head. In one embodiment, the member is a pin and the actuator comprises an opening for receiving the pin. The removable member is a generally U-shaped clip in a second embodiment. The darts are preferably manufactured from soft compressible material. A string may extend from the launcher and be pulled for cocking the launcher. Alternatively, the removable member may be used as a tool for cocking the launcher.

DETAILED DESCRIPTION

Figure 1:
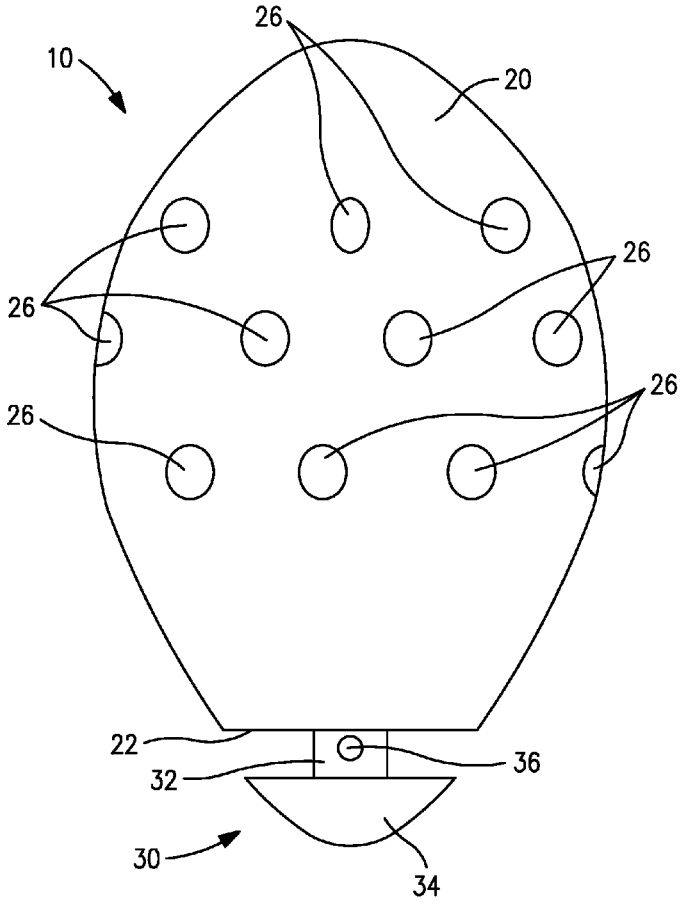
FIG. 1 is a side elevational view of a toy hand grenade, portions removed.

With reference to the drawings wherein like numerals represent like parts throughout the several figures, a toy hand grenade is generally designated by the numeral 10. The toy hand grenade 10 is adapted to generally resemble a hand grenade in overall appearance and is configured to function in a way that simulates the general action of the hand grenade for purposes of child's play and in a child-safe manner.

The toy hand grenade 10 includes a general oval shaped body 20 which at one end 22 is truncated. An actuator 30 extends from a throughbore 24 at the truncated end 22 of the body. The actuator 30 includes a stem 32. The stem connects with a generally enlarged contoured detonator head 34.

The body 20 defines a plurality of cylindrical bores 26 which in one form are generally identical in shape and dimension. The bores 26 open through the body surface and extend interiorly into the body in a direction generally toward a central portion of the body. Alternatively, the bores may be formed by sleeves.

Figure 2:
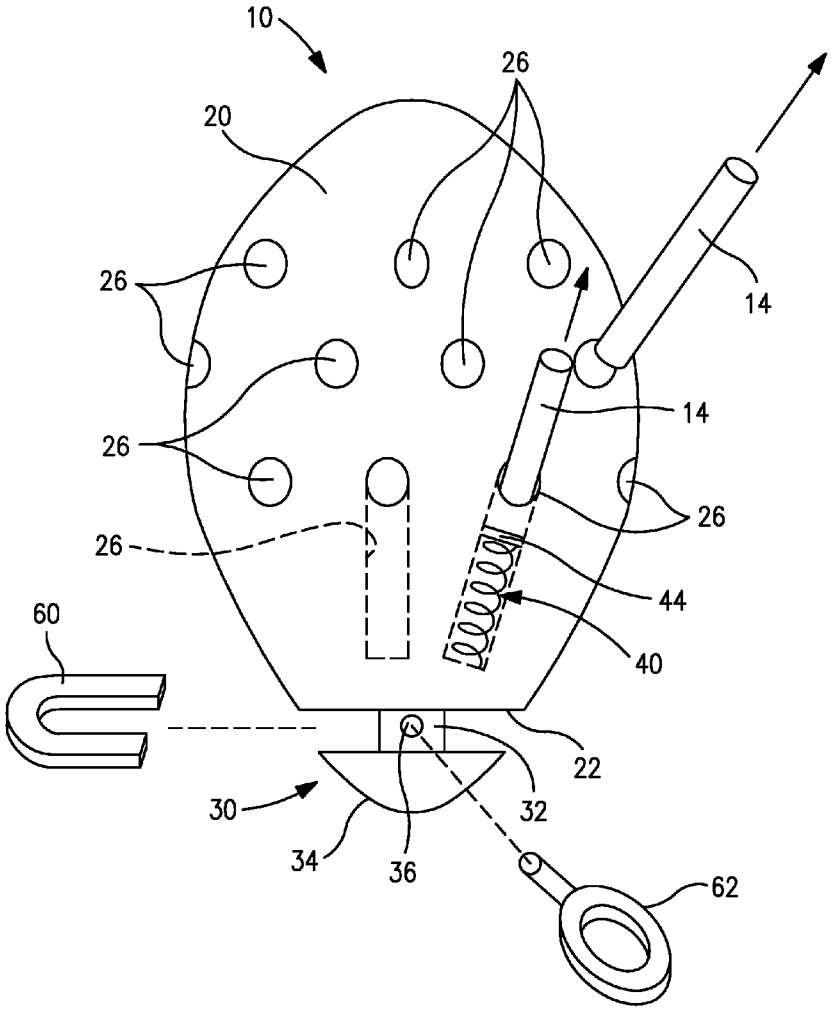
FIG. 2 is a side elevational view, partly in diagram form and partly in phantom, of the toy hand grenade of FIG. 1.
Figure 3:
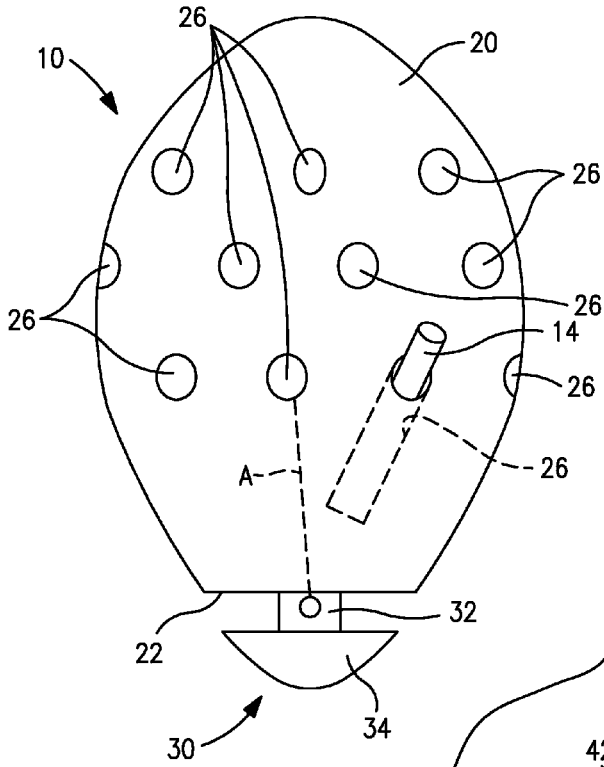
FIG. 3 is an elevational view, partly in phantom, of the toy hand grenade of FIG. 1 together with a representative dart.
Figure 4:
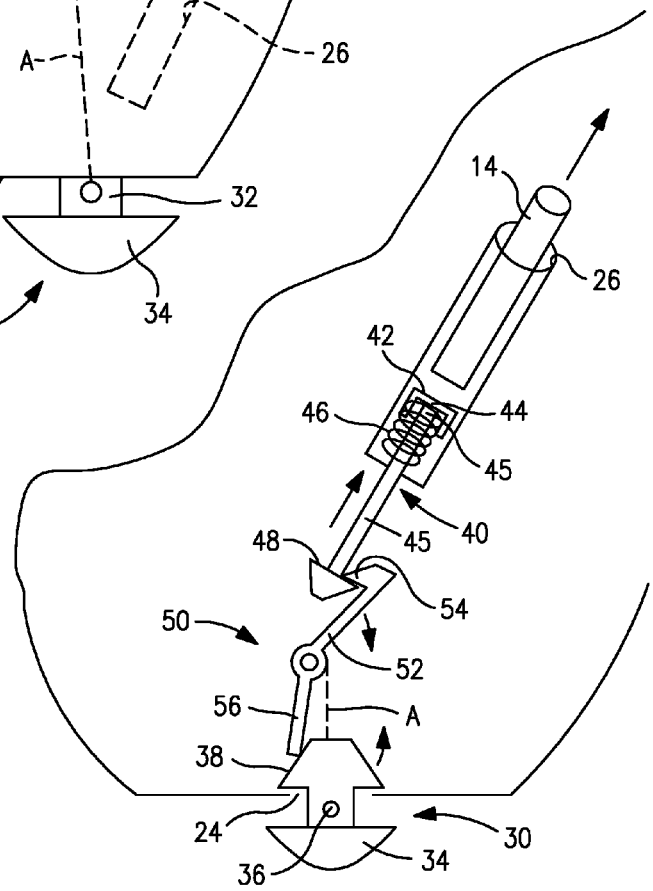
FIG. 4 is an enlarged fragmentary view, partly in schematic and partly in diagram form, illustrating the operation of the toy hand grenade of FIG. 1.

With reference to FIGS. 2-4, each of the bores 26 receives and generally houses a dart 14. Each dart 14 is manufactured from a foam or soft compressible material. The darts 14 may be cylindrical as illustrated or assume various other shapes.

With reference to FIG. 4, a launcher 40 is positioned at the interior end portion of each bore 26. Upon loading a dart in a bore, the lower end of the dart engages an injector cap 42 of the launcher. The launcher 40 has a T-shaped end 44 including a leg 45. The launcher captures a compression spring 46 disposed between the end of the bore and the underside of the end 44 and coiled around the leg 45. The leg 45 extends inwardly into the body and mounts an end flange 48.

Each launcher 40 has an associated trigger 50. Each trigger 50 includes an obliquely angled lever arm 52 which is pivotally mounted at an intermediate location at the interior of the body. The trigger includes a latch 54 which engages the flange 48 of the launcher. The opposed end of the trigger includes an integral arm 56.

The actuator 30 includes a truncated conical head 38 having a surface which engages each of the arms 56 of each of the triggers as they are angularly arranged about the central axis A of the body. In an actuated position, the latch 54 of the trigger engages the retention flange 48 of the launcher to compress the spring 46 and retract the ejector cap 42. The latch position is ensured by the engagement of the arm 56 against the surface of head 38.

When the actuator 30 is axially displaced, as shown by the associated arrow in FIG. 4, the arm rides down the surface and causes the trigger 50 to pivot and thereby disengage the latch 54 to release the launcher 40 which is loaded under the spring force. Each launcher ejector cap 42 engages the end of each dart 14 to substantially concurrently propel each dart from a bore 24. The FIG. 4 arrows illustrate the dart ejection (detonation) moment.

It will be appreciated that there are multiple bores 26 each with a launcher 40. In addition each launcher 40 has an associated trigger 50 which secures the launcher in a spring-loaded pre-actuated position.

The relationship between the spring loaded launcher 40 and the trigger 50 as engaged by the surface of head 38 is such that the launcher 40 is maintained in the primed cocked condition. The relationship between the actuator stem 32 and the corresponding throughbore 24 of the body may also be sufficiently tight that ordinarily, the actuator will be retained in a quasi-force-fit relationship spaced from the truncated end 32.

With reference to FIG. 2, a clip 60 is inserted around the stem to maintain the cocked (locked) position. Alternatively, a pin 62 may be inserted through an opening 36 of the stem to lock the actuator 30.

Figure 5:
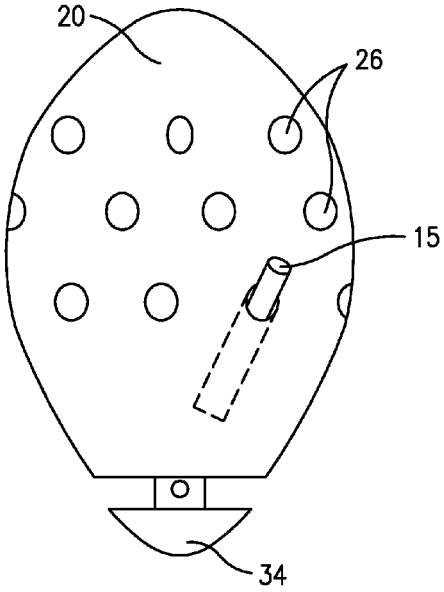
FIG. 5 is an elevational view, partly in phantom, of the toy hand grenade of FIG. 1, together with a tool employed for cocking the hand grenade.
Figure 6:
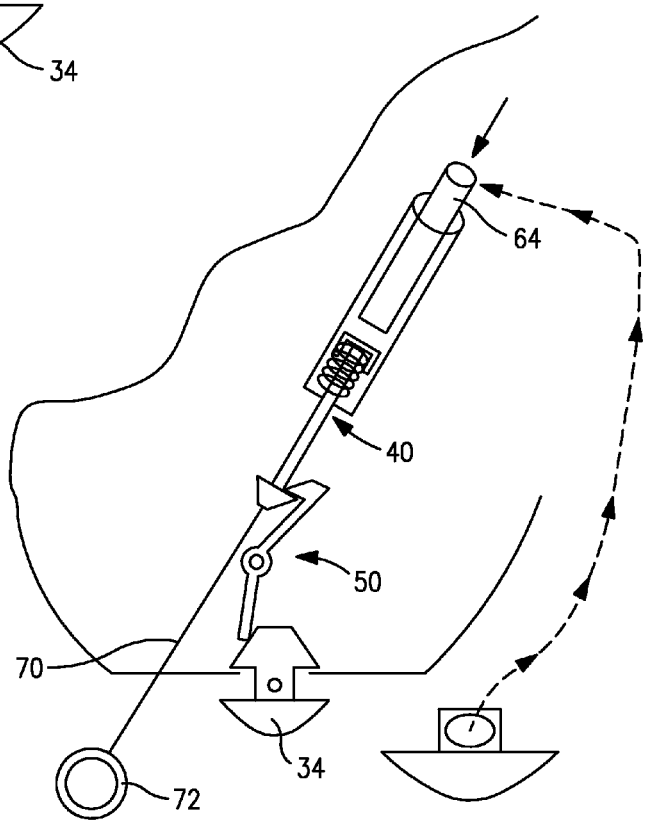
FIG. 6 is an enlarged fragmentary view, partly in schematic and partly in diagram form, further illustrating two methods of cocking the toy hand grenade of FIG. 1.

With reference to FIGS. 5 and 6, the grenade may be primed or cocked in a number of ways. A rigid dart shaped tool 15 may be employed to compress each spring prior to loading a foam dart 14. Alternatively, each launcher 40 piston can be retracted into tension by a member connected to an activating button (not illustrated). As illustrated in FIG. 6, a pull string 70 connects each launcher 40 and extends through the actuator end. The pull string 70 preferably has a ring 72. The ring and/or string are pulled to compress the spring for priming the launcher 40. In some embodiments, the actuator pull pin 64 essentially functions as the priming tool 15.

In operation, clip 60 or pin 62 or pin 64 is removed. The grenade weight is distributed at the actuator end so that the actuator head 34 ordinarily initially strikes the ground when the grenade is thrown. The toy hand grenade 10 is thus thrown so that the actuator head 34 engages a surface and moves in the direction of the associated FIG. 4 arrow to release the triggers and activate the launchers 40 to thereby propel the darts 14 from the body 20.

What is claimed:

1. A toy hand grenade comprising:

a retainer body having a plurality of bores;

a catch having an upper latch and an opposed trigger lever;

a spring loaded launcher for each said bore engaged by said catch;

an actuator extending exteriorly from said body and slidable therewith between an actuated and an unactuated position, said actuator interiorly engageable against said launcher to retain said launcher in a cocked position when said actuator is in an unactuated position; and a plurality of darts each received in a said bore and engageable against a said launcher, so that when said actuator is forced to the actuated position, said actuator causes said trigger levers to release said launchers and cause said darts to be ejected from said bores.

2. The toy hand grenade of claim 1 wherein each said launcher has a generally T-shaped cross-section.

3. The toy hand grenade of claim 1 wherein said catch and said trigger lever are disposed at a substantially oblique angle about a medial pivot point.

4. The toy hand grenade of claim 1 wherein said actuator has an enlarged head.

5. The toy hand grenade of claim 1 and further comprising a removable member for locking said actuator in the unactuated position.

6. The toy hand grenade of claim 5 wherein said member is a pin and said actuator comprises an opening for receiving said pin.

7. The toy hand grenade of claim 5 wherein said removable member is a generally U-shaped clip.

8. The toy hand grenade of claim 1 wherein said catch is pivotal and said actuator causes said trigger levers to pivot to release said launchers.

9. The toy hand grenade of claim 1 wherein said darts are manufactured from soft compressible material.

10. The toy hand grenade of claim 1 wherein said retainer body has an oval-like shape.

11. The toy hand grenade of claim 1 further comprising a string extending from a launcher.

12. A toy hand grenade comprising:

a retainer body having a plurality of bores;

a pivotal catch having an upper latch and an opposed trigger lever;

a spring loaded launcher for each said bore engaged by said catch;

an actuator extending exteriorly from said body and slidable therewith between an actuated and an unactuated position, said actuator interiorly engageable against said launcher to retain said launcher in a cocked position when said actuator is in an unactuated position;

a removable member for locking said actuator in the unactuated position; and a plurality of darts each received in a said bore and engageable against a said launcher, so that when said member is removed and said actuator is forced to the actuated position, said actuator causes said trigger levers to pivot to release said launchers and cause said darts to be ejected from said bores.

* * * * *